US010320107B2

(12) United States Patent
Schoenenberg

(10) Patent No.: US 10,320,107 B2
(45) Date of Patent: Jun. 11, 2019

(54) HEADER CONNECTOR COMPRISING AN INTERIOR UNDERCUT SPACE

(71) Applicant: Aptiv Technologies Limited, St. Michael (BB)

(72) Inventor: Florian Schoenenberg, Nuremberg (DE)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 15/794,574

(22) Filed: Oct. 26, 2017

(65) Prior Publication Data

US 2018/0138625 A1 May 17, 2018

(30) Foreign Application Priority Data

Nov. 15, 2016 (EP) ..... 16198794

(51) Int. Cl.
*H01R 13/66* (2006.01)
*H01R 13/405* (2006.01)
(Continued)

(52) U.S. Cl.
CPC ..... *H01R 13/405* (2013.01); *H01R 13/504* (2013.01); *H01R 13/518* (2013.01);
(Continued)

(58) Field of Classification Search
CPC ..... H01R 13/40; H01R 13/405; H01R 13/41; H01R 13/42; H01R 13/422; H01R 13/504;
(Continued)

(56) References Cited

U.S. PATENT DOCUMENTS 3,930,703 A * 1/1976 Kinast ..... H01R 13/518 439/97
4,810,208 A * 3/1989 Hayes ..... H01R 13/5208 439/281
(Continued)

FOREIGN PATENT DOCUMENTS

DE 4038756 C1 4/1992
DE 4224618 A1 1/1994
FR 2757690 A1 6/1998

OTHER PUBLICATIONS

Translation. FR2757690(B1). Jean, Ittah. Electrical connector for vehicle electronic calculator unit.*

*Primary Examiner* — Edwin A. Leon
*Assistant Examiner* — Milagros Jeancharles
(74) *Attorney, Agent, or Firm* — Robert J. Myers

(57) ABSTRACT

A header connector comprising a frame for receiving an interface portion. The header connector comprises at least two interface portions. Each interface portion comprises a side wall portion that protrudes inwards into the frame opposite to the mating direction. The side wall portion has an outer side wall surface and an opposing inner side wall surface. A lock protrusion transversely protrudes away from the outer side wall surface into the frame perpendicular to the mating direction. The frame comprises an interior undercut space at least partly defined by the bottom wall and the inner side wall surface. The interior undercut space is occupied by a portion of the frame, preferably by means of over molding.

10 Claims, 4 Drawing Sheets

(51) Int. Cl.

| | |
|---|---|
| ***H01R 13/504*** | (2006.01) |
| ***H01R 13/518*** | (2006.01) |
| ***H01R 13/52*** | (2006.01) |
| ***H01R 25/00*** | (2006.01) |
| ***H01R 43/24*** | (2006.01) |

(52) U.S. Cl.
CPC ..... *H01R 13/5219* (2013.01); *H01R 25/006* (2013.01); *H01R 43/24* (2013.01); *H01R 2201/26* (2013.01)

(58) Field of Classification Search
CPC .. H01R 13/506; H01R 13/514; H01R 13/516; H01R 13/518; H01R 13/5219; H01R 25/006; H01R 43/24; H01R 2201/26
USPC ..... 439/267, 283, 736, 540.1, 606; 264/19, 264/219–227, 229, 251, 271.1, 279.1, 286
See application file for complete search history.

(56) References Cited

U.S. PATENT DOCUMENTS

| | | | | | |
|---|---|---|---|---|---|
| 5,626,480 | A * | 5/1997 | Baumbaugh | H05K 7/16 | 439/260 |
| 5,779,493 | A * | 7/1998 | Tomita | H01R 13/5219 | 439/271 |
| 6,164,160 | A * | 12/2000 | Nassar | F16H 61/0009 | 29/840 |
| 6,517,368 | B2 * | 2/2003 | Hara | H01R 13/521 | 439/271 |
| 6,866,529 | B2 * | 3/2005 | Hobson | H01R 13/5202 | 439/271 |
| 7,021,952 | B2 * | 4/2006 | Drescher | H01R 13/4365 | 439/282 |
| 7,448,908 | B2 * | 11/2008 | Iwahori | H01R 13/5219 | 439/587 |
| 8,167,634 | B2 * | 5/2012 | Fujiwara | H01R 13/5202 | 439/271 |
| 9,225,103 | B2 * | 12/2015 | Okamoto | H01R 13/5202 | |
| 10,056,709 | B2 * | 8/2018 | Kashiwada | H01R 13/44 | |
| 2003/0162421 | A1 * | 8/2003 | Pratt | H01R 13/6658 | 439/76.1 |
| 2005/0122694 | A1 * | 6/2005 | Kane | H05K 5/0069 | 361/752 |
| 2005/0150674 | A1 * | 7/2005 | Munoz | H01R 13/52 | 174/53 |
| 2014/0045373 | A1 | 2/2014 | Kaesser | | |
| 2015/0044903 | A1 * | 2/2015 | Gruber | H05K 5/0069 | 439/540.1 |
| 2015/0288108 | A1 * | 10/2015 | Fischer | H01R 13/5219 | 439/88 |
| 2015/0372413 | A1 * | 12/2015 | Kataoka | H01R 13/521 | 439/271 |
| 2017/0302019 | A1 * | 10/2017 | Horiuchi | H01R 13/5202 | |

* cited by examiner

HEADER CONNECTOR COMPRISING AN INTERIOR UNDERCUT SPACE

CROSS-REFERENCE TO RELATED APPLICATION

This application claims the benefit under 35 U.S.C. § 119(a) of Patent Application No. 16198794.6 filed in the European Patent Office on Nov. 15, 2016, the entire disclosure of which is hereby incorporated by reference.

TECHNICAL FIELD OF THE INVENTION

The invention relates to a header connector and a method of producing a header connector. In particular, such header connectors are used in the automotive industry for connecting to a counterpart connector.

BACKGROUND OF THE INVENTION

In the automotive industry, header connectors are used for distributing power and/or data in a vehicle. Typically, header connectors comprise multiple interface portions. Each interface portion defines a receptacle to receive a portion of a counterpart connector. The number of pins, the size of the pins and the number of interface portions are flexible to comply with respective requirements. For example, for different applications or type of vehicles a different number of interface portions may be required. In the prior art it is known to produce header connectors in a modular way. That is, multiple interface portions are molded and subsequently assembled to a frame that is molded separately. Typical ways of assembling an interface portion to the frame is by means of gluing, ultrasonic welding and/or laser welding. Each of these methods comes with their advantages and disadvantages. Gluing an interface portion to the frame to form a header connector has as disadvantage that additional material with adhesive properties is mandatory. Additional equipment is needed to place glue at predefined regions of the interface portion and the frame.

Ultrasonic welding requires dedicated equipment (sonotrode) for generating ultrasonic vibrations.

Laser welding requires dedicated thermoplastic material with laser transparent properties in order to assemble the frame to the interface portion.

Typically, above methods for assembling are performed after the interface portion and the frame are molded. Before assembly, the interface portion and the frame need to be stored and moved to the assembly equipment.

FIGS. 1*a*, 1*b* and 1*c* show respectively six interface portions A, a frame B with six recesses for receiving said interface portions A and a header connector C according to the prior art. In alternative embodiments, any numbers of interface portions with corresponding recesses are possible. For example, one, two, three, four or five interface portions with the same respective number of corresponding recesses are possible.

In the prior art it is known to injection mold multiple interface portions A and subsequently store them. The frame B is injection molded separately and stored before being assembled to the interface portions A.

FIG. 1*c* shows the header connector C comprising the interface portions A and the frame B in an assembled state.

Such a header connector C and method for producing a header connector C are assembled by means of gluing, ultrasonic welding and/or laser welding. Drawback of such techniques is that it requires adhesive material and/or additional special equipment and/or it limits the type of material for the frame and interface portions to have it suitable to be welded.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

An object of the invention is to reduce the above mentioned drawbacks or to at least provide an alternative.

In particular, it is an object of the invention to provide a header connector and method for producing such header connector that takes less time and is more efficient.

In particular, the object of the invention is solved by means of a header connector for mechanically and electrically connecting to a counterpart connector which comprises a frame comprising a top surface. The top surface, when the header connector is connected to the counterpart connector, faces the counterpart connector. The top surface comprises at least two recesses for receiving an interface portion.

The header connector comprises at least two interface portions each respectively received in the at least two recess.

Each interface portion comprises a bottom wall and side walls protruding perpendicular away from the top surface and the bottom wall.

The side walls and the bottom wall define a receptacle with an opening for receiving the counterpart connector.

The mating direction of the header connector is parallel with the side walls and points away from the bottom wall towards the opening. Therefore the top surface faces in a direction similar as the mating direction.

Each interface portion comprises a side wall portion that protrudes inwards into the frame in a direction opposite to the mating direction. In other words, a portion of the interface portion is embedded in the frame.

The side wall portion has an outer side wall surface and an opposing inner side wall surface.

A lock protrusion transversely protrudes away from the outer side wall surface into the frame in a direction perpendicular to the mating direction.

The frame comprises further of an interior undercut space at least partly defined by the bottom wall and the inner side wall surface.

The interior undercut space is occupied by a portion of the frame by means of over molding. In other words, the interior undercut space is filled by means of over molding and forms an integral part of the frame.

Preferably, the lock protrusions are over molded and are fully embedded in the frame. A part of the top surface of the frame is therefore higher than the locking protrusions seen in a plane parallel to the mating direction.

Over molding the frame, and by that embedding the interface portion into the frame, has as advantage that an additional assembly step of assembling the frame to the interface portions may be omitted. The interior undercut space and the lock protrusion that protrudes away from the outer side wall surface allows an over molded frame with robust mechanical properties. The lock protrusions allow a firm locking and keying of the interface portion into the frame while the interior undercut space contributes to consistent and robust mechanical properties.

The object of the invention is also solved by means of a method for producing a header connector. In particular, the method relates to producing a header connector according to one of the above embodiments.

The method comprises the step of providing at least two interface portions, each interface portion comprising a bottom wall and side walls, the side walls protruding perpendicular away from the bottom wall, the side walls and the bottom wall defining a receptacle with an opening for receiving a counterpart connector, the mating direction of the header connector being parallel with the side walls and pointing away from the bottom wall towards the opening, the side wall portion having an outer side wall surface and an opposing inner side wall surface, wherein a lock protrusion transversely protrudes away from the outer side wall perpendicular to the mating direction and wherein the frame comprises an interior undercut space at least partly defined by the bottom wall and the inner side wall surface.

The method further comprises the step of aligning at least two interface portions side by side at a same height level. The height level is seen in a plane parallel to the mating direction.

The method further comprises the step of molding a frame around at least a portion of the at least two interface portions by means of over molding such that a side wall portion protrudes inwards into the frame, and covering by over molding the lock protrusions such that they protrudes into the frame and occupying by over molding the interior undercut space.

This has advantage that it allows for omitting a separate assembling step for assembling the interface portions to the frame. Instead, the frame is molded by over molding directly the interface portions. In other words, assembling the interface portions into the frame is integrated with the injection molding of the frame by over molding the interface portions. The locking protrusions being over molded allows a firm locking and keying of the interface portion into the frame while the interior undercut space contributes to consistent and robust mechanical properties.

In an embodiment of the header connector according to the invention, the interior undercut space is at a same height level as the lock protrusions. The height of the header connector is defined along a direction parallel to the mating direction.

This has as advantage that a compact sealing may be acquired together with a firm locking of the interface portion into the frame.

In another embodiment of the header connector according to the invention, each interface portion comprises a seal protrusion that protrudes from the bottom wall into the interior undercut space.

This has as advantage that a better sealing of the interface portions can be acquired. The seal protrusions are provided in the interior undercut space where there is less mechanical and dynamic tension due to an external load on the header connector. In other words, the seal protrusions may be protected against mechanical and dynamic tension which may increase the effectiveness of the seal protrusions. External loads on the header connector are absorbed by the locking protrusions as they provide the keying and locking of the interface portion into with the frame.

In a further embodiment, the header connector is provided with multiple seal protrusions having a triangular shape seen in a plane parallel to the mating direction. The base of the triangular shape is provided at the bottom surface of the interface portion such that a point of the triangular shape extends into the interior undercut space along a direction parallel to the mating direction.

This has as advantage a better adhesion between over molded material into the interior undercut space and the seal protrusions may be acquired.

In a further embodiment, the interior undercut space of at least one interface portion defines an elongated groove seen in a plane perpendicular to the mating direction wherein the seal protrusions are elongated inside the elongated groove. Preferably, the seal protrusions are elongated and enclose terminal openings provided in the interface portion seen in a plane perpendicular to the mating direction. In a further preference, the seal protrusions are elongated and define a rectangular shape seen in a plane perpendicular to the mating direction.

This has as advantage that the seal protrusions are able to seal an interior of the interface portion.

In an embodiment, a locking protrusion of a first interface portion faces a locking protrusion of a second interface portion at a same height level.

This may result in less tension and torsion in the frame when two neighboring interface portions are being exerted with a load.

In an embodiment of the method of producing a header connector according to the invention, over molding the frame is done by subsequently embedding the at least two interface portions.

In a further embodiment of the method, the over molding of the frame starts near a first interface portion and is followed by over molding the frame near a neighboring interface portion. In other words, each interface portions is over molded one after another starting with the first interface portion and continued with a neighboring interface portion.

Further features and advantages will appear more clearly on a reading of the following detailed description of the preferred embodiment, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1A:
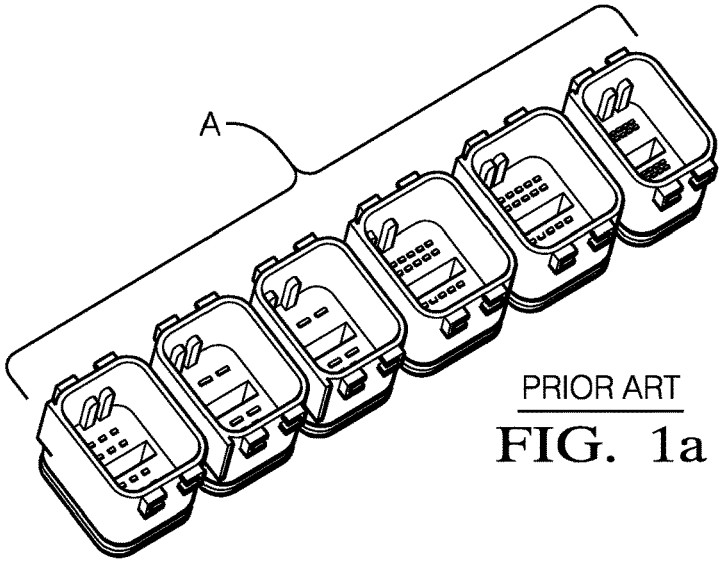
PRIOR ART FIG. 1a
FIG. 1*a* shows a perspective view of multiple interface portions according to the prior art.
Figure 1B:
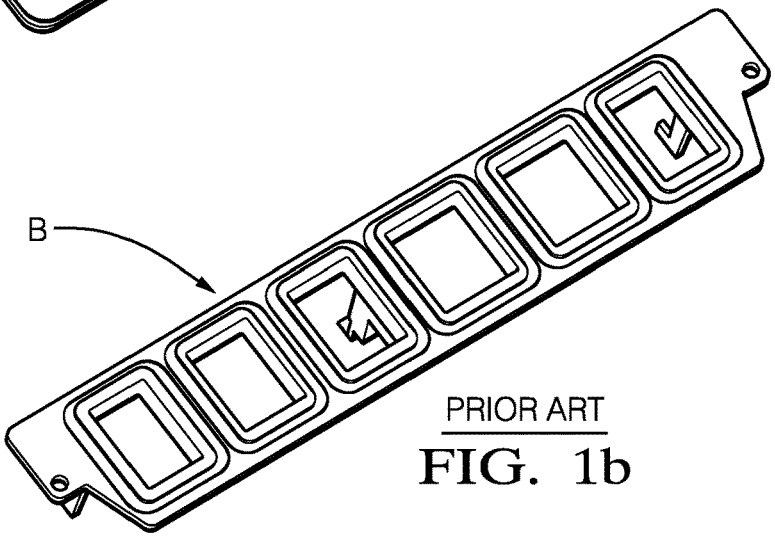
PRIOR ART FIG. 1b
FIG. 1*b* shows a perspective view of a frame according to the prior art.
Figure 1C:
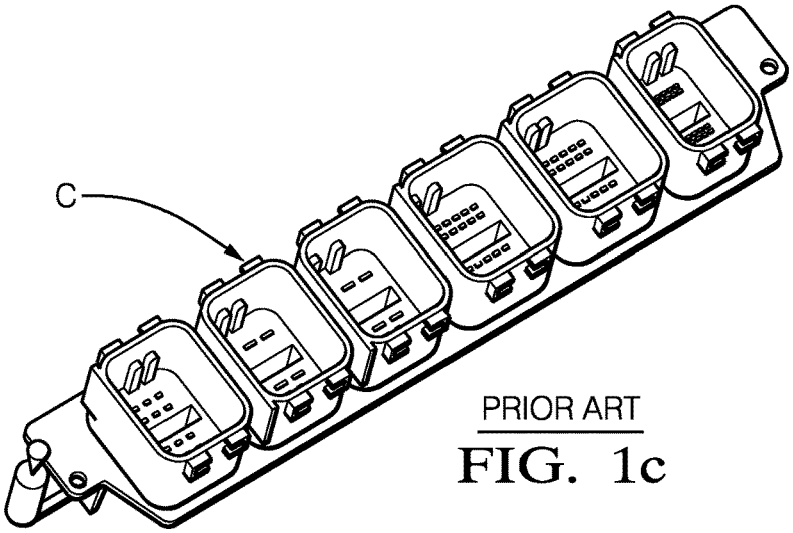
PRIOR ART FIG. 1c
FIG. 1*c* shows a perspective view of header connector comprising the multiple interface portions and the frame according to the prior art.
Figure 2A:
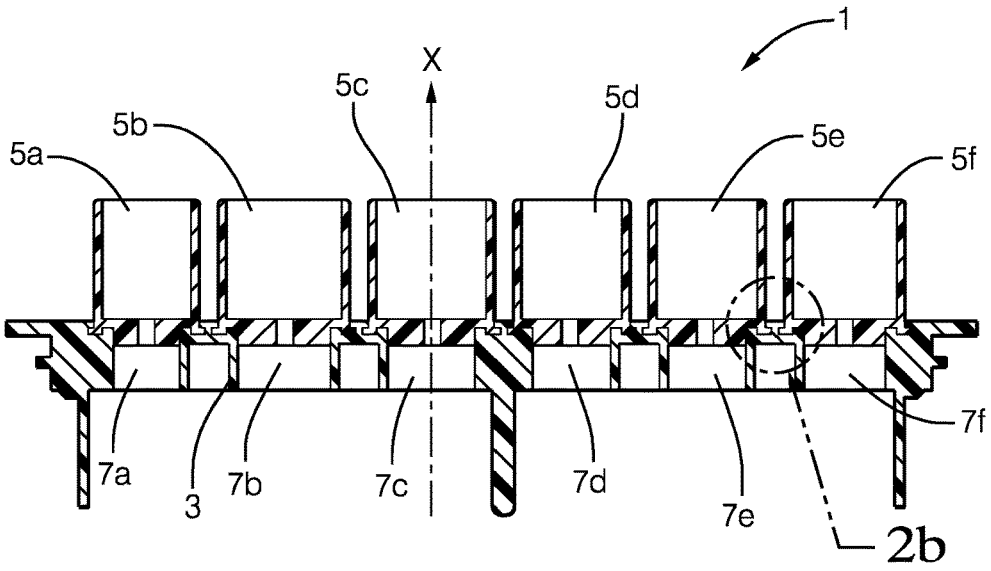
FIG. 2*a* shows a side view of a header connector according to a first embodiment.

FIG. 2*a* shows a non-limiting example of a header connector 1 according to a first embodiment of the invention. The header connector 1 comprises of six interface portions 5*a*, 5*b*, 5*c*, 5*d*, 5*e*, 5*f* which are provided in six corresponding recesses 7*a*, 7*b*, 7*c*, 7*d*, 7*e*, 7*f* in a frame 3. The header connector 1 is suitable for mechanically and electrically connecting to a counterpart connector (not shown). These header connectors 1 are typically used in automotive industry to connect for example a distribution box to a wire harness.

The frame 3 comprises a top surface, wherein the top surface comprises six recesses 7*a*, 7*b*, 7*c*, 7*d*, 7*e*, 7*f* each for receiving one of the six interface portions 5*a*, 5*b*, 5*c*, 5*d*, 5*e*, 5*f*.

Figure 2B:
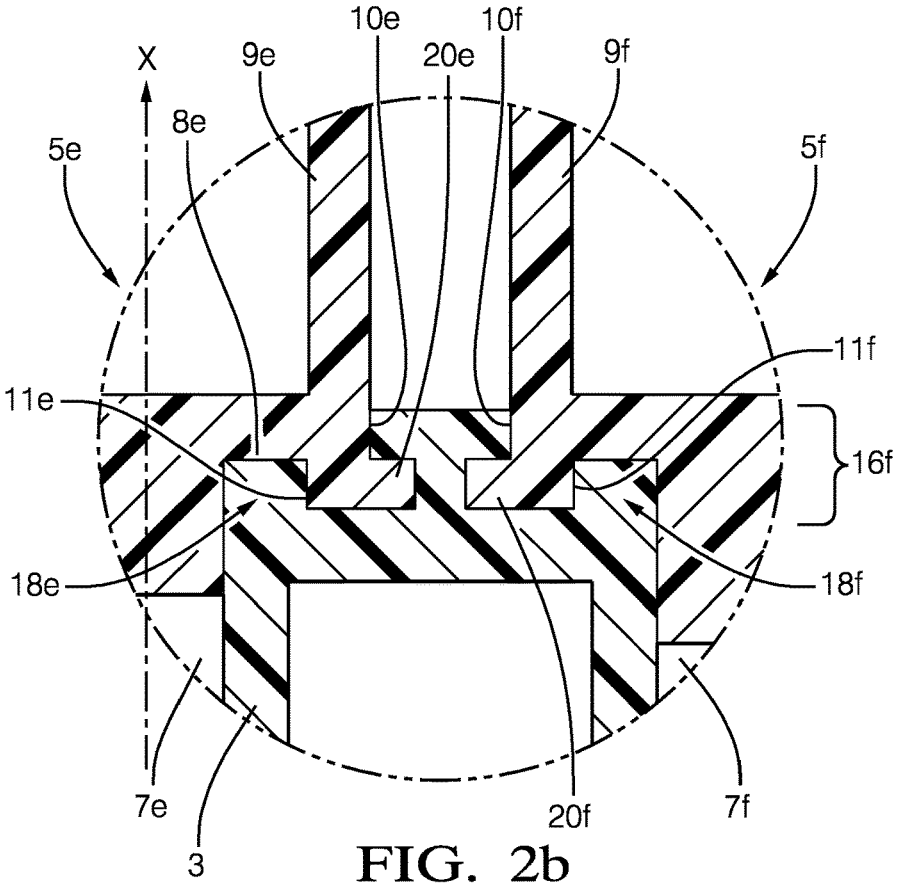
FIG. 2*b* shows a detailed side view of an interface portion and a frame according to the first embodiment.

Each interface portion 5*a*, 5*b*, 5*c*, 5*d*, 5*e*, 5*f* comprises a bottom wall 8*e*, 8*f* and side walls 9*e*, 9*f* which is best shown in FIG. 2*b* for the fifth interface portion 5*e* and the sixth interface portion 5*f*.

The side walls 9*e*, 9*f* protrude perpendicular away from the top surface and the bottom wall 8*e*, 8*f*. The side walls 9*e*, 9*g* and the bottom wall 8*e*, 8*f* define a receptacle with an opening for receiving the counterpart connector, or at least a part thereof.

The mating direction X of the header connector 1 is parallel with the side walls 9*e*, 9*f* and points away from the bottom wall 8*e*, 8*f* towards the opening. In FIG. 2*a*, the mating direction X points upwards.

Each of the six interface portions comprises 5*a*, 5*b*, 5*c*, 5*d*, 5*e*, 5*f* a side wall portion 16*e*, 16*f* that protrudes inwards into the frame 3 opposite to the mating direction X.

The side wall portion 16*e*, 16*f* has an outer side wall surface 10*e*, 10*f* and an opposing inner side wall surface 11*e*, 11*f*.

A lock protrusion 20*e*, 20*f* transversely protrudes away from the outer side wall surface 10*e*, 10*f* into the frame 3, i.e. perpendicular to the mating direction X.

The frame 3 comprises an interior undercut space 18*e*, 18*f* at least partly defined by the bottom wall 8*e*, 8*f* and the inner side wall surface 11*e*, 11*f*.

The interior undercut space 18*e*, 18*f* is occupied by a portion of the frame by means of over molding. In other words, the frame 3 is over molded thereby filling the interior undercut space 18*e*, 18*f* and covering the lock protrusions 20*e*, 20*f*. This allows for a keying and locking of the interface portions 5*a*, 5*b*, 5*c*, 5*d*, 5*e*, 5*f* into the frame 3 in a consistent way.

The interior undercut space 18*e*, 18*f* is at a same height level as the lock protrusions 20*e*, 20*f*.

The locking protrusion 20*e* of the fifth interface portion 5*e* faces the locking protrusion 20*f* of the sixth interface portion 20*f* at a same height level.

Figure 3:
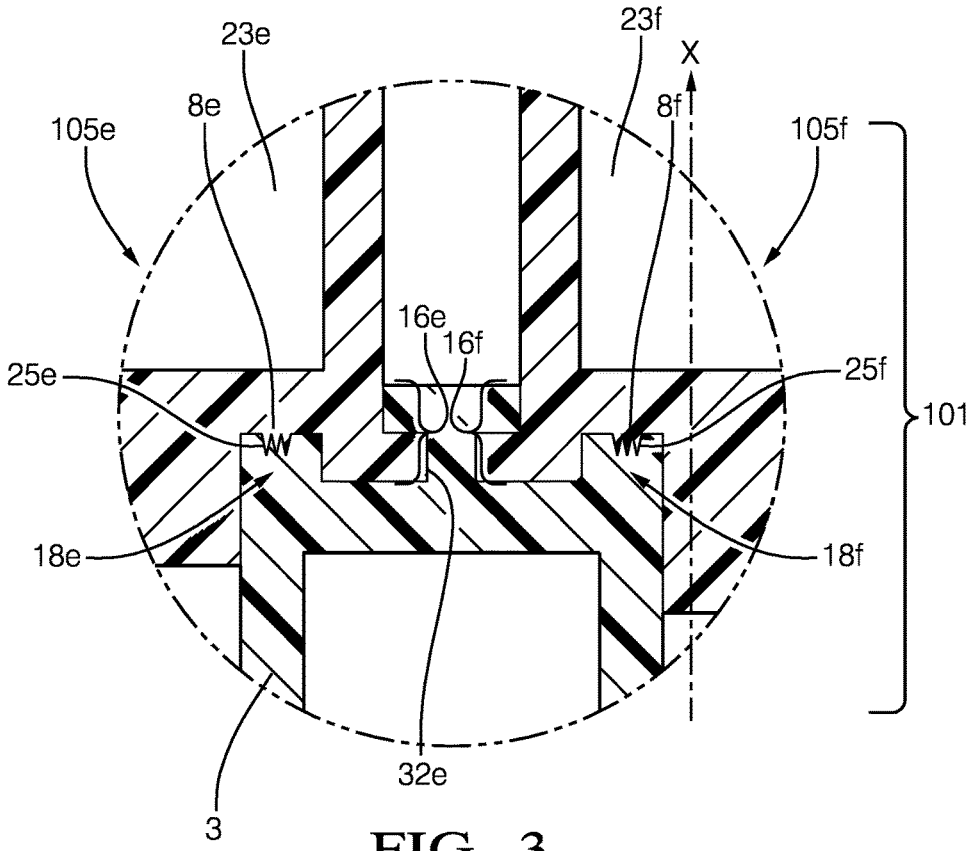
FIG. 3 shows a detailed side view of an interface portion and a frame according to a second embodiment.

FIG. 3 shows a detail of another non-limiting example of a header connector 101 according to a second embodiment. The second embodiment is similar to the first embodiment and identical reference numbers refer to identical features.

The second embodiment differs from the first embodiment in that each of the six interface portions 105*e*, 105*f* comprises a seal protrusion 25*e*, 25*f* that protrudes from the bottom wall 8*e*, 8*f* into the interior undercut space 18*e*, 18*f*.

Each side wall portion 16*e*, 16*f* comprises multiple triangular shaped seal protrusions.

Figure 4:
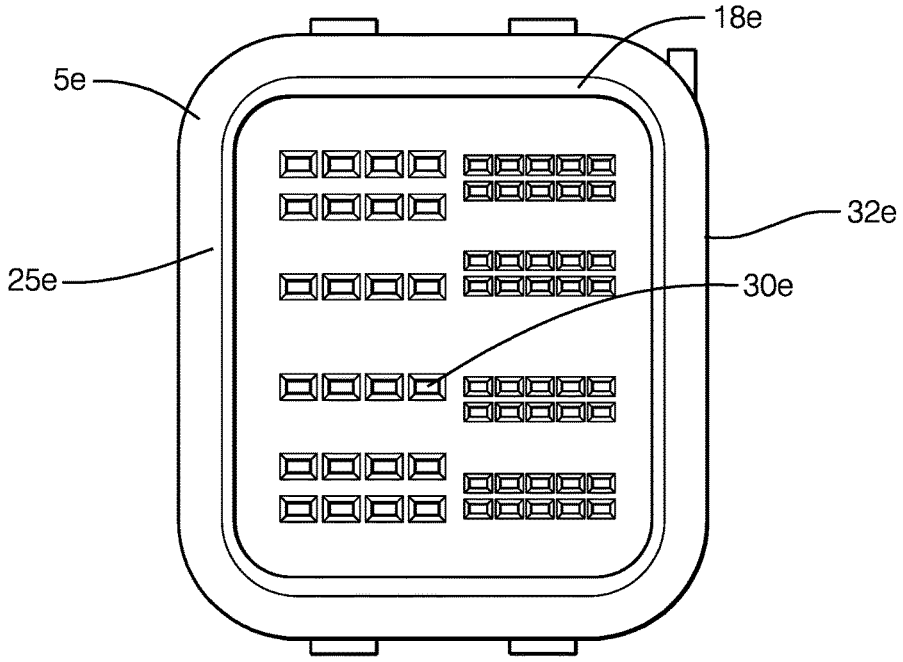
FIG. 4 shows a detailed bottom view of an interface portion according to the second embodiment.

FIG. 4 shows a bottom view one interface portion 5*e* according to the second embodiment. Although only one interface portion 5*e* is shown, the other interface portions 5*a*, 5*b*, 5*c*, 5*d*, 5*f* preferably have similar features. The interface portion 5*e* comprises terminal openings 30*e*. The interior undercut space 18*e* is elongated along an outer edge 32*e* of the lock protrusion 20*e* of the interface portion 5*e*. The interior undercut space 18*e* is elongated defining an elongated groove and encloses the terminal opening 30*e* and preferably encloses all terminal openings, seen in this plane perpendicular to the mating direction X. The interior undercut space 18*e* in this view is rectangular shaped and has a similar shape as the outer edge 32*e* of the interface portion 5*e*. Other shapes are also possible. Preferably the interior undercut space 18*e* has an elongated groove shape similar to the shape of the outer edge 32*e* of the interface portion 5*e*. Alternatively, both shapes may differ. Inside the interior undercut space 18*e* the seal protrusion 25*e* extends along the full length of the interior undercut space 18*e*. Therefore in this embodiment, the seal protrusion 25*e* has a similar rectangular shape as the interior undercut space 18*e*. The seal protrusion 25*e* encloses the terminal opening 30*e* and preferably encloses all terminal openings seen in this plane perpendicular to the mating direction X. The seal protrusion 25*e* is provided between the terminal opening 30*e* and the outer edge 32*e* of the interface portion 5*e* for sealing the terminal openings against for example fluids external to the interface portion 5*e*.

Figures 5A, 5B, 5C:
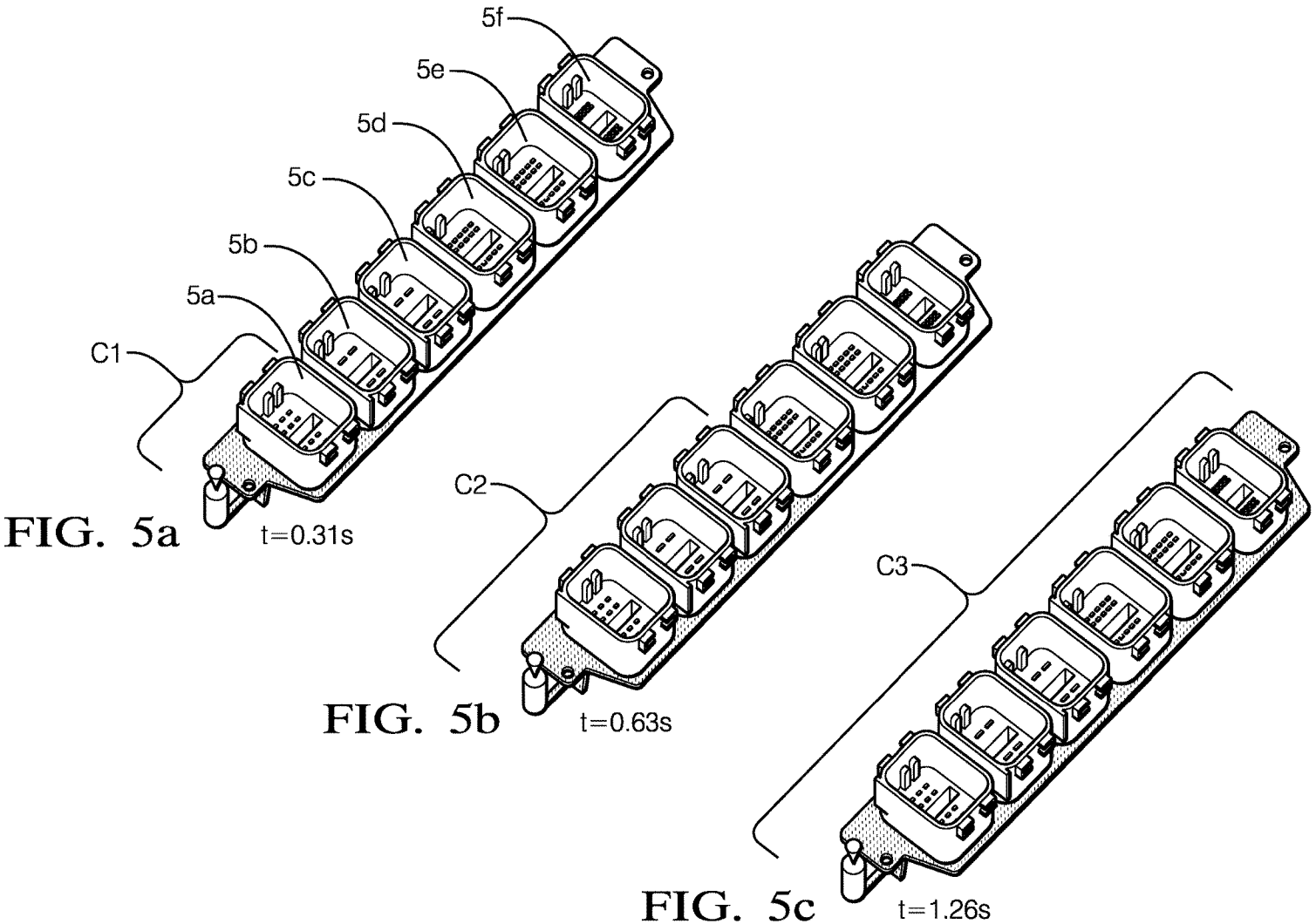
FIG. 5*a* shows an over molding step for a method of producing a header connector according to a first embodiment.
FIG. 5*b* shows a subsequent over molding step for a method of producing the header connector according to the first embodiment.
FIG. 5*c* shows a final over molding step for a method of producing the header connector according to the first embodiment.

FIGS. 5*a*, 5*b* and 5*c* show part of a method for producing a header connector 1, 101. The method is particular suitable for producing the header connectors 1, 101 as described above. The method comprises the step of providing at least two interface portions 5*a*, 5*b*, 5*c*, 5*d*, 5*e*, 5*f*, each interface portion 5*a*, 5*b*, 5*c*, 5*d*, 5*e*, 5*f* comprising a bottom wall 8*e*, 8*f* and side walls 9*e*, 9*f*, the side walls 9*e*, 9*f* protruding perpendicular away from the bottom wall 8*e*, 8*f*, the side walls 9*e*, 9*f* and the bottom wall 8*e*, 8*f* defining a receptacle 23*e*, 23*f* with an opening for receiving a counterpart connector, the mating direction X of the header connector 1 being parallel with the side walls 9*e*, 9*f* and pointing away from the bottom wall 8*e*, 8*f* towards the opening, a side wall portion 16*e*, 16*f* of the side walls 9*e*, 9*f* having an outer side wall surface 10*e*, 10*f* and an opposing inner side wall surface 11*e*, 11*f*, wherein a lock protrusion 20*e*, 20*f* transversely protrudes away from the outer side wall surface 10*e*, 10*f* perpendicular to the mating direction X and wherein each interface portion 5*a*, 5*b*, 5*c*, 5*d*, 5*e*, 5*f* comprises an interior undercut space 18*e*, 18*f* at least partly defined by the bottom wall 8*e*, 8*f* and the inner side wall surface 11*e*, 11*f*.

The method further comprises the step of aligning at least two interface portions 5*a*, 5*b*, 5*c*, 5*d*, 5*e*, 5*f* side by side at a same height level.

The method further comprises the step of molding a frame 3 around at least a portion of the at least two interface portions 5*a*, 5*b*, 5*c*, 5*d*, 5*e*, 5*f* by means of over molding such that the side wall portion 16*e*, 16*f* protrudes inwards into the frame 3, and covering by over molding the lock protrusions 20*e*, 20*f* such that they protrude into the frame 3 and occupy by over molding the interior undercut space 18*e*, 18*f*.

As can be seen in FIGS. 5*a*, 5*b* and 5*c*, the over molding of the frame 3 is done by subsequently embedding the at least two interface portions 5*a*, 5*b*, 5*c*, 5*d*, 5*e*, 5*f*.

Here, the over molding of the frame 3 starts near a first interface portion 5*a* and is followed by over molding the frame near a neighboring interface portion, in this case the second interface portion 5*b*. Subsequently the third, the fourth, the fifth and the sixth interface portions 5*c*, 5*d*, 5*e*, 5*f* are over molded.

In FIGS. 5*a*, 5*b* and 5*c* respectively three stages of over molding are shown. In a first stage C1 only part of the first interface portion 5*a* is over molded. In a second stage C2 the first, the second and the third interface portion 5*a*, 5*b*, 5*c* are over molded. In a third stage C3 all six interface portions 5*a*, 5*b*, 5*c*, 5*d*, 5*e*, 5*f* are over molded.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

I claim:

1. A header connector configured to mechanically and electrically connect to a counterpart connector, comprising:

a frame comprising a top surface, the top surface comprising at least two recesses for receiving an interface portion; and at least two interface portions each respectively received in the at least two recesses, each interface portion comprising a bottom wall and side walls protruding perpendicular away from the top surface and the bottom wall, the side walls and the bottom wall defining a receptacle with an opening for receiving the counterpart connector, a mating direction of the header connector being parallel with the side walls and pointing away from the bottom wall towards the opening, wherein each interface portion comprises a side wall portion that protrudes inwards into the frame opposite to the mating direction, the side wall portion having an outer side wall surface and an opposing inner side wall surface, wherein a lock protrusion transversely protrudes away from the outer side wall surface into the frame perpendicular to the mating direction and wherein the frame comprises an interior undercut space at least partly defined by the bottom wall and an inner side wall surface, and wherein each interface portion comprises a seal protrusion that protrudes from the bottom wall into the interior undercut space.

2. The header connector according to claim 1, wherein the interior undercut space is at a same height level as the lock protrusion.

3. The header connector according to claim 1, wherein each interface portion comprises multiple triangular shaped seal protrusions seen in a plane parallel to the mating direction.

4. The header connector according to claim 1, wherein the interior undercut space of at least one interface portion defines an elongated groove seen in a plane perpendicular to the mating direction wherein the seal protrusion is elongated inside the elongated groove.

5. The header connector according to claim 1, wherein the seal protrusion is elongated and enclose terminal openings provided in the interface portion seen in a plane perpendicular to the mating direction.

6. The header connector according to claim 1, wherein the seal protrusion is elongated and define a rectangular shape seen in a plane perpendicular to the mating direction.

7. The header connector according to claim 1, wherein a first locking protrusion of a first interface portion faces a second locking protrusion of a second interface portion at a same height level.

8. A method for producing a header connector, comprising the steps of:

providing at least two interface portions, each interface portion comprising a bottom wall and side walls, the side walls protruding perpendicular away from the bottom wall, the side walls and the bottom wall defining a receptacle with an opening for receiving a counterpart connector, a mating direction of the header connector being parallel with the side walls and pointing away from the bottom wall towards the opening, a side wall portion of the side walls having an outer side wall surface and an opposing inner side wall surface, wherein a lock protrusion transversely protrudes away from an outer side wall perpendicular to the mating direction, wherein each interface portion comprises an interior undercut space at least partly defined by the bottom wall and an inner side wall surface, and wherein each interface portion comprises a seal protrusion that protrudes from the bottom wall into the interior undercut space;

aligning at least two interface portions side by side at a same height level;

molding a frame around at least a portion of the at least two interface portions by means of over molding such that the side wall portions protrude inwards into the frame, and cover by over molding the lock protrusion such that they protrude into the frame and occupy by over molding the interior undercut space.

9. The method according to claim 8, wherein over molding the frame is done by subsequently embedding the at least two interface portions.

10. The method according to claim 9, wherein the over molding of the frame starts near a first interface portion and is followed by over molding the frame near a neighboring interface portion.

* * * * *